US012098665B2

(12) United States Patent
Heo

(10) Patent No.: US 12,098,665 B2
(45) Date of Patent: Sep. 24, 2024

(54) OIL PAN NOISE REDUCTION DEVICE

(71) Applicant: Hyundai Transys Inc., Seosan-si (KR)

(72) Inventor: Hyeseong Heo, Hwaseong-si (KR)

(73) Assignee: Hyundai Transys Inc., Seosan-si (KR)

( * ) Notice: Subject to any disclaimer, the term of this patent is extended or adjusted under 35 U.S.C. 154(b) by 0 days.

(21) Appl. No.: 18/348,638

(22) Filed: Jul. 7, 2023

(65) Prior Publication Data

US 2024/0167401 A1 May 23, 2024

(30) Foreign Application Priority Data

Nov. 21, 2022 (KR) ..... 10-2022-0156618

(51) Int. Cl.
*F02B 77/04* (2006.01)
*F01M 11/00* (2006.01)

(52) U.S. Cl.
CPC . *F01M 11/0004* (2013.01); *F01M 2011/0012* (2013.01)

(58) Field of Classification Search
CPC ..... F01M 11/0004; F01M 2011/0012; F01M 2011/0008; F02B 77/13; F02F 7/008
USPC ..... 123/198 E
See application file for complete search history.

(56) References Cited

U.S. PATENT DOCUMENTS 4,423,707 A * 1/1984 Sihon ..... F02B 67/04 123/198 C
6,058,898 A * 5/2000 Freese, V ..... F01M 11/0004 123/196 AB
6,155,226 A * 12/2000 Ozawa ..... F02B 77/11 123/195 C

FOREIGN PATENT DOCUMENTS

| | | | |
|---|---|---|---|
| DE | 3929592 | A1 | 3/1991 |
| DE | 19739778 | A1 | 3/1998 |
| JP | S62-87152 | U | 6/1987 |
| JP | H05-149376 | A | 6/1993 |
| KR | 10-2009-0056399 | A | 6/2009 |
| KR | 20-2013-0006141 | U | 10/2013 |
| KR | 10-2022-0011422 | A | 1/2022 |
| KR | 10-2022-0156618 | A | 11/2022 |

OTHER PUBLICATIONS

Florian, "Office Action for DE Application No. 102023123049.2", May 27, 2024, DPMA, München, Germany.

* cited by examiner

*Primary Examiner* — Long T Tran
*Assistant Examiner* — James J Kim
(74) *Attorney, Agent, or Firm* — Bridgeway IP Law Group, PLLC; Jihun Kim

(57) ABSTRACT

An oil pan noise reduction device includes an oil pan, a mounting plate positioned at one side of the oil pan, and a damping member positioned between the oil pan and the mounting plate, in which the mounting plate includes a depressed portion formed in one surface of the mounting plate directed toward the oil pan, and a protruding portion disposed in the depressed portion and protruding from the depressed portion.

9 Claims, 3 Drawing Sheets

OIL PAN NOISE REDUCTION DEVICE

CROSS-REFERENCE TO RELATED APPLICATIONS

This application claims priority to and the benefit of Korean Patent Application No. 10-2022-0156618 filed in the Korean Intellectual Property Office on Nov. 21, 2022, the entire contents of which are incorporated herein by reference.

TECHNICAL FIELD

The present invention relates to an oil pan noise reduction device mounted in an automatic transmission.

BACKGROUND ART

In general, in an automatic transmission, oil is pumped and supplied by an oil pump that operates in conjunction with an operation of an engine. The oil may be provided to a corresponding friction element of a planetary gear train through a flow path. The oil may be supplied to various types of operating components of the planetary gear train and lubricate and cool the components. An oil pan for storing oil may be mounted at a lateral side of the automatic transmission (a front side of a vehicle).

It can be seen that noise resonance is caused by an overlap between planetary gear noise and steel oil pan frequency during a process of measuring noise of the automatic transmission. According to a result of measuring noise at a planetary gear side, a peak noise region (about 500 to 900 Hz) occurs at about 1,000 and 2,000 rpm.

Accordingly, there is a need for a technology to solve the problem of noise caused by the overlap between the planetary gear noise and the steel oil pan frequency.

DOCUMENT OF RELATED ART

Patent Document (Patent Document 1) Korean Patent Application Laid-Open No. 10-2009-0056399 (published on Jun. 3, 2009)

SUMMARY OF THE INVENTION

The present invention has been made in an effort to provide an oil pan noise reduction device, in which a damping member is coupled between a metal oil pan and a mounting plate to suppress noise generated by the oil pan.

An exemplary embodiment of the present invention provides an oil pan noise reduction device including: an oil pan; a mounting plate positioned at one side of the oil pan; and a damping member positioned between the oil pan and the mounting plate.

The mounting plate may include: a depressed portion formed in one surface directed toward the oil pan; and a protruding portion provided in the depressed portion and protruding from the depressed portion.

One surface of the damping member, which is directed toward the mounting plate, may be inserted into the depressed portion.

The damping member may have a center hole, and the protruding portion of the mounting plate may be inserted into the center hole.

A coupling portion may be provided on one surface of the oil pan directed toward the damping member.

The coupling portion may be recessed.

The other surface of the damping member, which is directed toward the oil pan, may be inserted into the coupling portion of the oil pan.

The damping member may be configured as an elastic member.

The elastic member may be made of rubber.

The mounting plate may be provided between the damping member and an oil cooler.

According to the present invention, the damping member is coupled between the metal oil pan and the mounting plate, thereby suppressing noise generated from the oil pan.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
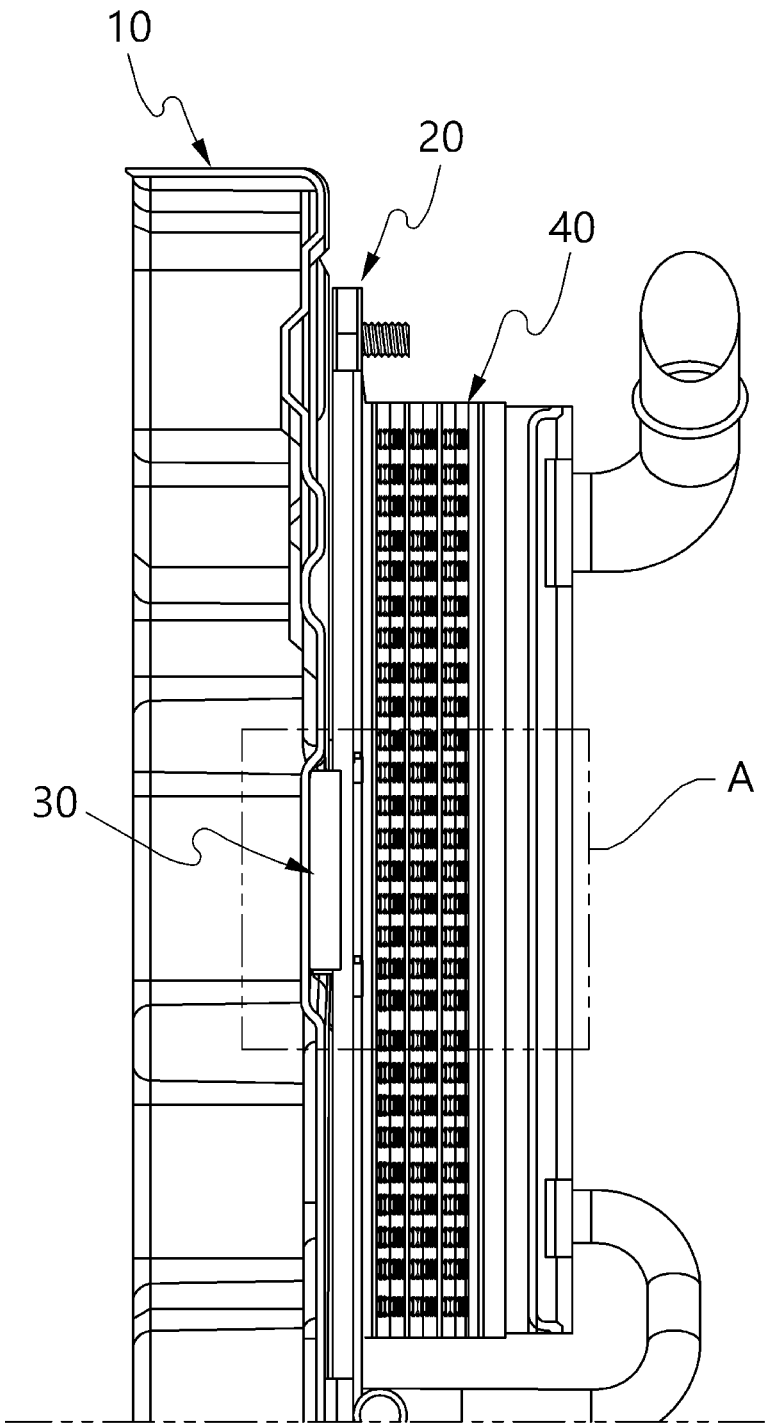
FIG. 1 is a view illustrating an oil pan noise reduction device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. First, in assigning reference numerals to constituent elements of the respective drawings, it should be noted that the same constituent elements will be designated by the same reference numerals, if possible, even though the constituent elements are illustrated in different drawings. In addition, in the description of the present invention, the specific descriptions of publicly known related configurations or functions will be omitted when it is determined that the specific descriptions may obscure the subject matter of the present invention. Further, the exemplary embodiments of the present invention will be described below, but the technical spirit of the present invention is not limited thereto and may of course be modified and variously carried out by those skilled in the art.

Figure 2:
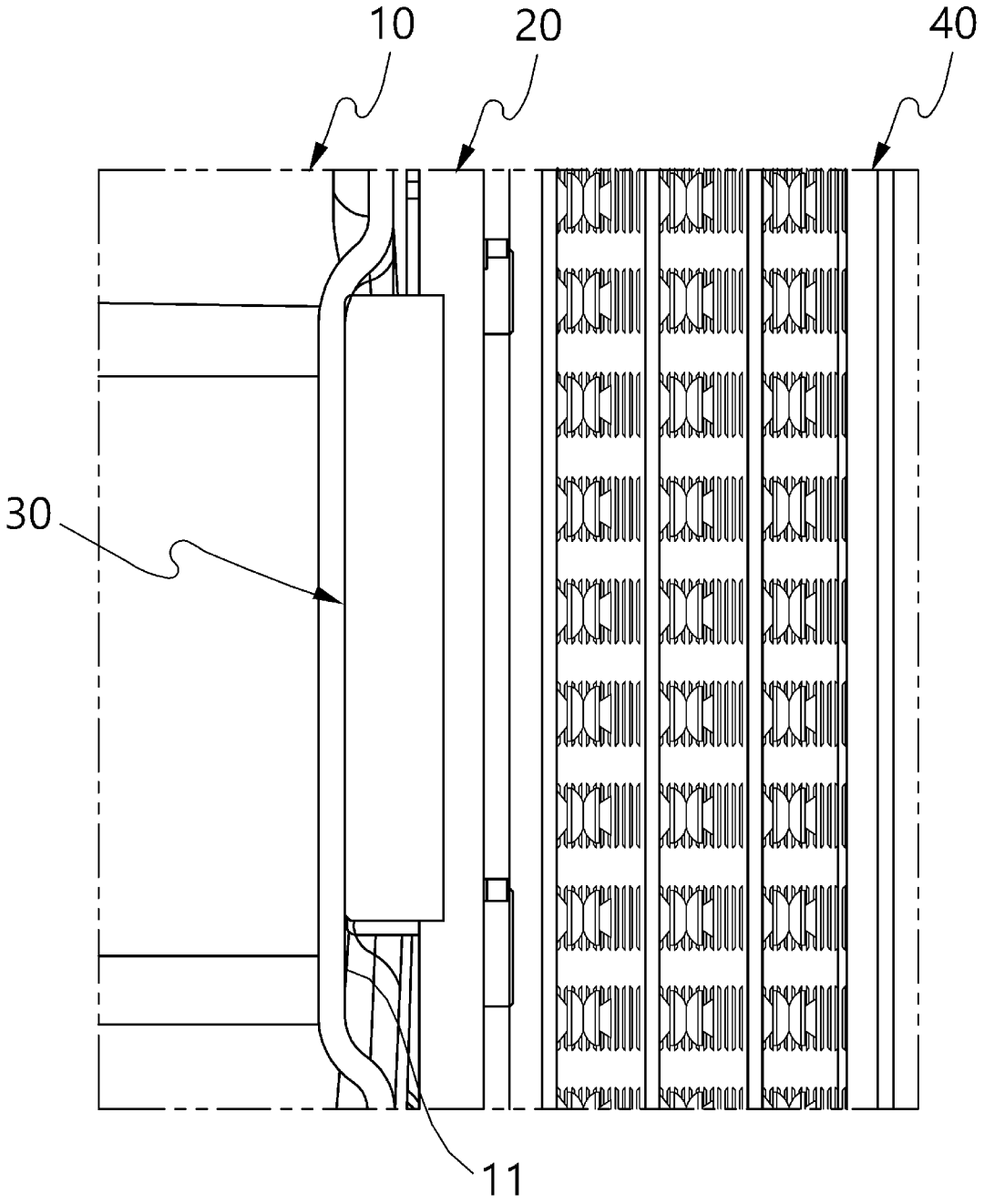
FIG. 2 is an enlarged view of part A in FIG. 1.
Figure 3:
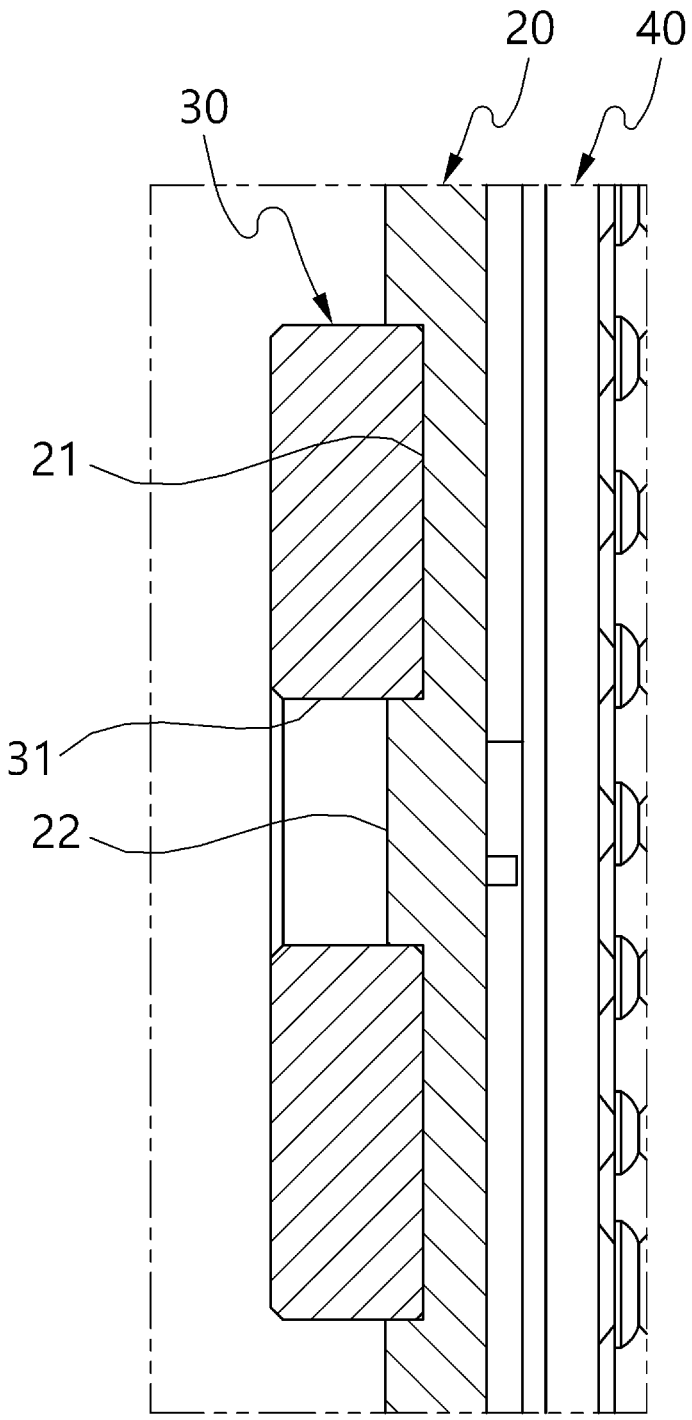
FIG. 3 is a view illustrating a state in which a damping member is coupled to a mounting plate according to the exemplary embodiment of the present invention.

FIG. 1 is a view illustrating an oil pan noise reduction device according to an exemplary embodiment of the present invention, FIG. 2 is an enlarged view of part A in FIG. 1, and FIG. 3 is a view illustrating a state in which a damping member is coupled to a mounting plate according to the exemplary embodiment of the present invention.

As illustrated in FIGS. 1 to 3, the present invention is characterized in that a damping member 30 is provided between an oil pan 10 and a mounting plate 20.

The oil pan 10 may be made of metal. The mounting plate 20 may be positioned between the damping member 30 and an oil cooler 40.

The mounting plate 20 may be positioned at one side of the oil pan 10. The mounting plate 20 includes a depressed portion 21 and a protruding portion 22.

The depressed portion 21 may be formed in one surface of the mounting plate 20 directed toward the oil pan 10. The depressed portion 21 has an inner-diameter portion that conforms to an outer-diameter portion of the damping member 30.

The protruding portion 22 may be provided at a center of the depressed portion 21. The protruding portion 22 may be provided in the form of a round bar. The protruding portion 22 may protrude from the depressed portion 21 toward the damping member 30.

The damping member 30 may be disposed between the oil pan 10 and the mounting plate and suppress noise generated from the oil pan 10.

The damping member 30 may be assembled such that one surface directed toward the mounting plate 20 is inserted into the depressed portion 21 of the mounting plate 20.

A center hole 31 may be provided at a center of the damping member 30. The center hole 31 may have an inner diameter portion that conforms to the protruding portion 22 of the mounting plate 20. The protruding portion 22 of the mounting plate 20 may be inserted into the center hole 31.

One surface of the damping member 30 is inserted into the depressed portion 21, and the protruding portion 22 is inserted into the center hole 31 when the damping member 30 is assembled with the mounting plate 20. Therefore, the damping member 30 may be securely coupled to the mounting plate 20, thereby maximizing the damping effect of the damping member 30.

The oil pan 10 has a coupling portion 11. The coupling portion 11 may be recessed in one surface of the oil pan 10 directed toward the damping member 30. The other surface of the damping member 30, which is directed toward the oil pan 10, may be inserted into the coupling portion 11.

The damping member 30 may be made of a material suitable to suppress noise. For example, the damping member 30 may be made of an elastic member such as rubber.

In the related art, noise is inevitably generated because no separate device capable of suppressing noise is provided on a metal oil pan.

However, in the present invention, the damper member may be disposed between the metal oil pan and the mounting plate and suppress noise generated from the metal oil pan.

As described above, the present invention provides the coupling structure in which one surface of the damping member is inserted into the depressed portion, the protruding portion of the mounting plate is inserted into the center hole, and the other surface of the damping member is inserted into the coupling portion of the oil pan at the time of assembling the damping member. Therefore, it is possible to implement the secure coupling structure and maximize the noise suppressing effect of the damping member.

The above description is simply given for illustratively describing the technical spirit of the present invention, and those skilled in the art to which the present invention pertains will appreciate that various modifications, changes, and substitutions are possible without departing from the essential characteristic of the present invention. Accordingly, the embodiments disclosed in the present invention and the accompanying drawings are intended not to limit but to describe the technical spirit of the present invention, and the scope of the technical spirit of the present invention is not limited by the embodiments and the accompanying drawings. The protective scope of the present invention should be construed based on the following claims, and all the technical spirit in the equivalent scope thereto should be construed as falling within the scope of the present invention.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An oil pan noise reduction device comprising:

an oil pan;

a mounting plate positioned at one side of the oil pan; and a damping member positioned between the oil pan and the mounting plate, wherein the mounting plate comprises:

a depressed portion defined on one surface of the mounting plate facing the oil pan; and a protruding portion disposed in the depressed portion and protruding from the depressed portion.

2. The oil pan noise reduction device of claim 1, wherein one surface of the damping member, which is facing the mounting plate, is configured to be inserted into the depressed portion.

3. The oil pan noise reduction device of claim 1, wherein the damping member has a center hole, and the protruding portion of the mounting plate is configured to be inserted into the center hole.

4. The oil pan noise reduction device of claim 1, wherein a coupling portion is disposed on one surface of the oil pan facing the damping member.

5. The oil pan noise reduction device of claim 4, wherein the coupling portion is recessed.

6. The oil pan noise reduction device of claim 4, wherein another surface of the damping member, which is facing the oil pan, is configured to be inserted into the coupling portion of the oil pan.

7. The oil pan noise reduction device of claim 1, wherein the damping member has an elastic member.

8. The oil pan noise reduction device of claim 7, wherein the elastic member has rubber.

9. The oil pan noise reduction device of claim 1, wherein the mounting plate is disposed between the damping member and an oil cooler.

* * * * *